US010008192B2

(12) United States Patent
Kreifeldt et al.

(10) Patent No.: US 10,008,192 B2
(45) Date of Patent: Jun. 26, 2018

(54) GUITAR PEDAL BOARD

(71) Applicant: Motoforza, Inc., South Jordan, UT (US)

(72) Inventors: Richard Kreifeldt, South Jordan, UT (US); Noel Larson, Draper, UT (US); Tyler Allan, Highland, UT (US)

(73) Assignee: Motoforza, Inc., South Jordan, UT (US)

( * ) Notice: Subject to any disclaimer, the term of this patent is extended or adjusted under 35 U.S.C. 154(b) by 0 days. days.

(21) Appl. No.: 15/353,493

(22) Filed: Nov. 16, 2016

(65) Prior Publication Data

US 2017/0140744 A1 May 18, 2017

Related U.S. Application Data

(60) Provisional application No. 62/255,807, filed on Nov. 16, 2015.

(51) Int. Cl.
*G10H 1/34* (2006.01)
*G10G 5/00* (2006.01)

(52) U.S. Cl.
CPC ..... *G10H 1/348* (2013.01); *G10G 5/00* (2013.01); *G10H 1/34* (2013.01); *G10H 2210/155* (2013.01)

(58) Field of Classification Search
CPC ..... G10H 1/348; G10H 2210/155; G10G 5/00
USPC ..... 84/453
See application file for complete search history.

(56) References Cited

U.S. PATENT DOCUMENTS 2,030,929 A * 2/1936 Miyashita ..... G10C 3/26 84/232
2,196,125 A * 4/1940 Smith ..... G05G 13/00 477/216
2,245,314 A * 6/1941 Willis ..... G10C 3/26 84/232
2,332,064 A * 10/1943 Duffy ..... G05G 1/487 74/526
2,500,619 A * 3/1950 Rook ..... B60W 10/18 477/217
3,255,326 A * 6/1966 Schwartz ..... G10H 1/348 200/86.5
3,287,992 A * 11/1966 Smith ..... B60K 26/02 251/295
4,278,004 A * 7/1981 Klann ..... G10C 3/14 84/227

(Continued)

*Primary Examiner* — David Warren
*Assistant Examiner* — Christina Schreiber
(74) *Attorney, Agent, or Firm* — Travis R. Banta; TechLaw Ventures, PLLC

(57) ABSTRACT

This disclosure generally relates to a guitar pedal board configured to maintain an open position and a closed position. In one embodiment, a surface of a guitar pedal board is configured to receive and hold guitar pedals on a surface that may be inclined relative to a surface on which the guitar pedal board rests. In another embodiment, the guitar pedal board includes one or more retainer stands that hold the guitar pedal board in a closed position. In another embodiment, the guitar pedal board includes a support member that holds the guitar pedal board in an open position. In another embodiment, a first guitar pedal board includes an attachment foot configured to attach one or more guitar pedal boards to the first guitar pedal board.

17 Claims, 5 Drawing Sheets

(56) References Cited

U.S. PATENT DOCUMENTS 5,452,951 A * 9/1995 Peller ..... H05K 7/16 108/6
5,866,829 A * 2/1999 Pecoraro ..... G10H 1/32 84/177
6,215,055 B1 * 4/2001 Saravis ..... G10H 1/348 84/422.1
6,459,023 B1 * 10/2002 Chandler ..... G10H 1/32 84/177
6,538,185 B1 * 3/2003 Stratton ..... G10H 1/32 84/422.1
6,967,272 B2 * 11/2005 Green ..... G10D 13/006 84/327
7,608,776 B2 * 10/2009 Ludwig ..... G10H 1/32 84/721
8,138,406 B2 * 3/2012 Vinciguerra ..... G10H 1/0091 84/421
D682,925 S * 5/2013 Urry ..... D17/20
8,614,385 B2 * 12/2013 McKinney ..... G10H 1/348 84/453
8,642,870 B1 * 2/2014 Rosa ..... A47G 27/0212 84/453
D745,923 S * 12/2015 Trifilio ..... D17/20
9,401,133 B2 * 7/2016 McGinly ..... G10H 1/32
D769,364 S * 10/2016 Trifilio ..... D17/20
9,520,118 B2 * 12/2016 Canivell Grifols ..... G10G 5/00
2002/0183662 A1 * 12/2002 Lu ..... A61H 1/003 601/28
2003/0061930 A1 * 4/2003 Green ..... G10D 13/006 84/421
2004/0250673 A1 * 12/2004 Salerno ..... G10H 1/32 84/746
2007/0295190 A1 * 12/2007 Collins ..... G10H 1/32 84/422.1
2008/0098873 A1 * 5/2008 Kitagawa ..... G10H 1/348 84/422.1
2011/0271821 A1 * 11/2011 McKinney ..... G10H 1/348 84/746
2011/0303077 A1 * 12/2011 Vinciguerra ..... G10H 1/0091 84/746
2014/0131543 A1 * 5/2014 Goto ..... F16M 11/043 248/429
2015/0325224 A1 * 11/2015 Manosa Ripoll ..... G10H 1/32 84/444
2016/0086591 A1 * 3/2016 McGinly ..... G10H 1/32 84/453
2016/0171959 A1 * 6/2016 Canivell Grifols ..... G10G 5/00 84/453
2016/0258574 A1 * 9/2016 Abbate ..... G10H 1/32
2016/0260422 A1 * 9/2016 Canivell Grifols ..... G10H 1/32
2016/0293151 A1 * 10/2016 Mayo ..... G10H 1/0058
2017/0140744 A1 * 5/2017 Kreifeldt ..... G10H 1/348

* cited by examiner

GUITAR PEDAL BOARD

PRIORITY CLAIM

This application claims priority to U.S. Provisional Patent Application No. 62/255,807 filed on Nov. 16, 2015 which is hereby incorporated by reference.

BACKGROUND

1. Technical Field

This disclosure relates to a guitar pedal board configured to maintain a position for one or more guitar pedals in an ergonomic arrangement. More specifically, the guitar pedal board disclosed herein provides ready access to one or more guitar pedals while simultaneously providing a musician with easy access to electronic connections for the one or more guitar pedals contained inside the guitar pedal board.

2. Description of the Related Art

Guitar pedals are devices, typically connected between a guitar and a guitar amplifier, that modify, enhance, alter, distort, or provide any audio effect on sound produced by a guitar. One or more guitar pedals may be necessary for a musician to produce an intended effect on the sound produced by a guitar. Guitar pedals may be used individually or may be daisy chained together. In other words, the output of one guitar pedal may be connected to the input of another guitar pedal, the output of which may, in turn, be connected to the input of another guitar pedal.

As musicians arrange guitar pedals to produce a desired sound, the combinations and orientations of guitar pedals can become unwieldly. In an effort to both maintain the organization and orientation of various guitar pedals, guitar pedal boards have been developed. Guitar pedals connect to guitar pedal boards, typically using hook and loop tape. Accordingly, guitar pedal boards provide a fixed position for each guitar pedal used by a musician and allow a musician to move all of his guitar pedals at once.

One exemplary guitar pedal board is described in U.S. Pat. No. 6,459,023 titled "Mounting board for guitar effects." The mounting board described by U.S. Pat. No. 6,459,023 is constructed using a series of horizontal square tubes connected between two vertical square tubes, forming open channels between each of the horizontal square tubes in the series of horizontal square tubing. Guitar pedals are disposed along the horizontal square tubing which allows wires associated with the guitar pedals to be disposed in the channels.

However, this mounting board experiences several drawbacks. First, the wires associated with the guitar pedals typically fall into the channels between the horizontal square tubing. Since the mounting board is open to the sides and back, uncontained wires can extend outside of the mounting board and present a tripping hazard while a musician is playing on a stage. Second, the uncontained wires appear unprofessional, which detracts from the perceived quality of the music being played. Moreover, uncontained wires are unprotected by the mounting board which leaves the uncontained wires susceptible to damage that may reduce the audio quality of the music produced by the musician. Third, the mounting board is relatively unstable. In order to arrange the guitar pedals on the mounting board on an incline, the mounting board provides a frame base horizontally across the underside of the mounting board (on the back side of the mounting board—e.g. the side intended to be furthest from the musician). While the underside of the frame base is positioned such that a bottom surface area of the frame base is in full contact with a surface, such as a stage, the opposite side of the pedal board rests only on one corner of the horizontal square tubing (on the front side of the mounting board—e.g., the side intended to be closest to the musician). Because support on the front side of the pedal board rests only on one corner of the horizontal tubing, the front side of the mounting board slides more easily than the rear side of the mounting board. This causes the mounting board to slide along the stage when the musician is playing and trying to manipulate the guitar pedals on the mounting board with his feet. The degree of sliding is only exacerbated when a musician is interacting with his equipment in an exuberant fashion. Finally, while all of the guitar pedals are maintained in a single position on the mounting board, transportation of the mounting board becomes an issue when the uncontained wires are free to hang between the various guitar pedals on the mounting board, presenting a further tripping hazard. Disconnecting and reconnecting each pedal between instances of transport, however, is time consuming, repetitive, and undesirable.

Another example of a "musical effects pedal retaining device and pedal board" is disclosed in U.S. Pat. No. 8,614,385. The pedal board provides a mechanical attachment for attaching a guitar pedal to the pedal board. Further provided is a support arm that connects a base assembly of the pedal board to a mounting member of the pedal board. Accordingly, the mounting member of the pedal board may be disposed at various angles by connecting the support arm to the base assembly in one of a plurality of support openings. Essentially, the support arm provides the mounting member, onto which the guitar pedals are installed via the mechanical attachment, an ability to adjustably incline according to a musician's preferences. Essentially, the mounting member upon which the guitar pedals are mounted is configured to be positioned at some angle by rotating the mounting member around a pivot and then maintaining that angle by installing the support arm into one of the support openings.

This pedal board also suffers from some drawbacks. First, when the support arm maintains the mounting member at a particular angle (on an incline), the wires that connect the pedals together are not contained within the pedal board, creating tripping hazards. Accordingly, a musician must choose between his ability to reach the guitar pedals with ease and the potential tripping hazard that may be experienced by himself or other performers on stage. Further, even when the pedal board is opened (e.g., set at on an incline), a musician may experience substantial difficulty in connecting wiring disposed between various guitar pedals that may be mounted on the pedal board. Second, because the mounting member is allowed to be temporarily positioned at some angle relative to the base assembly, the pedal board may not be also held completely closed. Rather, in order to close the pedal board such that the mounting member and the base assembly are parallel to each other, the supporting member is positioned in an elongated support opening (element 70 in FIG. 8 of U.S. Pat. No. 8,614,385, for example). In this case, the support arm allows the mounting member to rotate around the pivot point and open and close to some extent as the support arm moves in the elongated support opening. During transport the ability of the mounting member to rotate such that the pedal board may slightly open and close may result in the support arm catching and/or cutting one or more wires associated with the guitar pedals on the pedal board. Finally, a particularly exuberant musician may forcefully interact with one or more guitar pedals on the pedal board. If the mounting member is disposed at an inclined position during the exuberant musician's forceful interaction with the one or more guitar pedals, the support arm may buckle or break, reducing the effectiveness of the pedal board. A musician may therefore lose the advantages of the ability to incline a pedal board.

Accordingly, it is one object of this disclosure to provide a guitar pedal board that provides an ability to position guitar pedals on an inclined surface. It is another object of this disclosure to contain wires associated with one or more guitar pedals within the guitar pedal board. It is another object of this disclosure to provide an ability for the guitar pedal board to open and close to enhance access to wiring.

It is a further object of this disclosure to provide one or more support members internal to the guitar pedal board. Yet another object of this disclosure is to provide one or more retainer within the guitar pedal board to hold the guitar pedal board closed during use and transport. Finally, another object of this disclosure is to provide an attachment foot that allows at least two pedal boards to be mechanically connected to each other.

SUMMARY

This disclosure generally relates to a pedal board that includes an upper portion and a bottom portion. The pedal board further includes a support member. The support member is extendible such that a length of the support member is extendible around at least one pivot point. The support member may be lengthened, for example, by unfolding the support member around the pivot point. The support member may be connected between the upper portion of the pedal board and the bottom portion of the pedal board to support the upper portion of the pedal board when open.

Further disclosed is a pedal board system. The pedal board system comprises a first pedal board and a second pedal board. The first pedal board and the second pedal board may be connected by an attachment foot.

BRIEF DESCRIPTION OF THE DRAWINGS

The accompanying drawings illustrate a guitar pedal board.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

While the following disclosure is described with reference to the use of a guitar, it should be noted that any stringed instrument with an electrical amplifier (a pre-amplifier) or an electrical jack may use various sound effect pedals in a manner similar to those used by guitarists. Further, while the description largely refers to the musician as the user of the guitar pedal board, this term is meant to include anyone who participates in the configuration, wiring, setup, or implementation of sound effect pedals on a guitar pedal board. Sound effect pedals may also be referred to as guitar pedals. However, references to a "guitar" pedal or the "guitar pedal board" herein do not limit any disclosure herein to use with a guitar. Rather, any musician who uses sound effects pedals including, but not limited to, bassists, keyboardists, and disc jockeys may use guitar pedals mounted on a guitar pedal board. Any pedal designed to manipulate sound produced by a musical instrument which may or may not be intended to be manipulated or controlled by the musician's foot may be implemented on the guitar pedal board disclosed herein.

Figure 1:
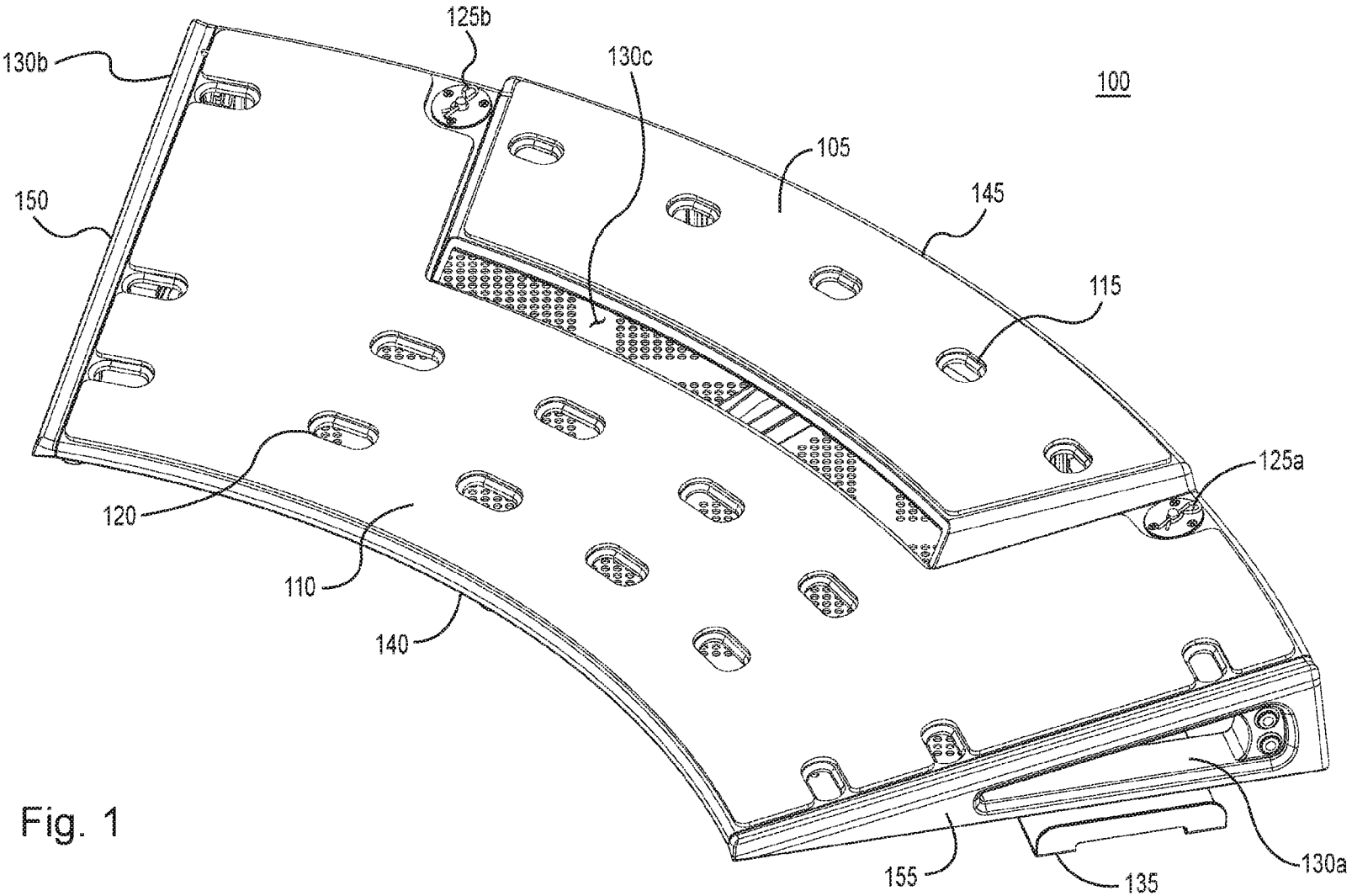
FIG. 1 illustrates a perspective view of the guitar pedal board.

FIG. 1 illustrates a perspective view of guitar pedal board 100. Guitar pedal board 100 may be constructed using any suitable material. For example, guitar pedal board 100 may be constructed using metal, wood, plastics, fiberglass, various hardened resins, carbon based composites or any other natural or synthetic material. Exemplary metals include aluminum, titanium, and steel, although alloys of various metals may be suitable. In one embodiment, guitar pedal board 100 may be constructed using aluminum and may be anodized. Guitar pedal board 100 may further be powder coated, painted, clear coated, or otherwise treated for aesthetic or durability purposes.

Guitar pedal board 100 is, for the purposes of explanation, generally shaped in the form of an arc (e.g. 90° of a circle). Although, guitar pedal board 100 is not limited to either an arc shape or a particular portion of a circle. Guitar pedal board 100 may be implemented as a rectangle or a portion of a polygon such as a pentagon, hexagon, heptagon, octagon, etc. However, arc shapes are generally ergonomically desirable for guitar pedal boards because arc shapes position guitar pedals such that the guitar pedals reduce stretch, strain, or contortion of human joints, such as ankles, knees, and more particularly, hips.

In one arc shaped embodiment of guitar pedal board 100, for example, a front side of guitar pedal board 100 is defined by 90° of a circle with a first radius 140 while a back side of guitar pedal board 100 is defined by 90° of a circle with a second radius 145. The second radius 145 is generally larger than the first radius 140, providing space on guitar pedal board 100 for various guitar pedals on upper guitar pedal board surface 105 and guitar pedal board surface 110. Upper guitar pedal board surface 105 is an integral portion of guitar pedal board surface 110 and is raised above the incline angle of guitar pedal board surface 110. Upper guitar pedal board surface 105 is also defined in a generally arcuate shape. While upper guitar pedal board surface 105 is shown as being flat (i.e., parallel to the surface on which guitar pedal board 100 rests), upper guitar pedal board surface 105 may also be inclined, as explained below with respect to guitar pedal board surface 110.

Guitar pedal board surface 110 is inclined relative to a bottom portion of the guitar pedal board (which will be discussed below) and which is generally positioned parallel to a floor, a stage, a podium, a stand, or some other surface where a musical performance is to occur. Guitar pedal board surface 110 is generally inclined relative to the bottom portion of the guitar pedal board (or the surface on which guitar pedal board 100 rests) at an angle of between substantially 0° and approximately 75°. Some musicians may prefer a very slight incline, closer to 1° while other musicians may prefer a more pronounced incline, closer to 70° or 75°. Guitar pedal board surface 110 may be constructed with an incline of any angle in the range of substantially 0° to approximately 75°. The incline of guitar pedal board surface 110 provides easier access to a variety of guitar pedals for musicians of different heights or different limb (leg/foot) lengths. Shorter musicians may prefer a higher angle of incline while taller musicians may prefer a lower angle of incline for guitar pedal board surface 110.

Upper guitar pedal board surface 105 includes one or more wiring ports 115 while guitar pedal board surface 110 includes one or more wiring ports 120. Guitar pedals may be disposed between two of wiring ports 115 or between two of wiring ports 120 and attached to upper guitar pedal board surface 105 or guitar pedal board surface 110 using hook and loop tape. An input wire may be inserted through one of wiring ports 115 or one of wiring ports 120 and connected to a guitar pedal. Similarly, an output wire may be inserted through one of wiring ports 115 or one of wiring ports 120 and connected to a guitar pedal. Accordingly, with only the exception of the wiring connectors of the input wires and the output wires, the remainder of the input wires and the output wires for the guitar pedals disposed on upper guitar pedal board surface 105 or guitar pedal board surface 110 may be safely contained within guitar pedal board 100.

Guitar pedal board 100 further includes one or more retaining devices. FIG. 1 illustrates two retaining devices, retaining device 125*a* and retaining device 125*b*. While retaining device 125*a* and retaining device 125*b* will be explained in more detail below, both retaining device 125*a* and retaining device 125*b* are used to hold guitar pedal board surface 110 to a bottom portion of guitar pedal board 100. Retaining device 125*a* and retaining device 125*b* may include a retaining pin that is used to releasably connect guitar pedal board surface 110 to a bottom portion of guitar pedal board 100.

Guitar pedal board 100 further includes various handles, implemented as right side handle 130*a*, left side handle 130*b*, and center handle 130*c*. Right side handle 130*a* is disposed within a right side plate 155 while left side handle 130*b* is disposed within a left side plate 150. Left side plate 150 and right side plate 155 are integrally connected to guitar pedal board surface 110 and provide ports suitable for grasping by a human hand. Center handle 130*c* is defined by gap between upper guitar pedal board surface 105 and guitar pedal board surface 110. This gap may be appropriately sized to be suitable for a human hand to grasp guitar pedal board 100 from the top. When guitar pedal board 100 is lifted for transport or movement by grasping one or more of right side handle 130*a*, left side handle 130*b*, and center handle 130*c*, guitar pedal board surface 110 is held to a bottom portion of guitar pedal board 100 by one or more retaining devices, such as retaining device 125*a* and/or retaining device 125*b*. Accordingly, even during transport, guitar pedal board 100 may be held in a closed state, keeping any electrical wires contained within guitar pedal board 100. This not only eliminates tripping hazards, but also provides a more professional appearance on stage than conventional pedal boards.

Finally, guitar pedal board 100 further includes an attachment foot 135 which may be used to attach guitar pedal board 100 to another similar guitar pedal board. A further explanation of attachment foot 135 will be provided below.

Figure 2:
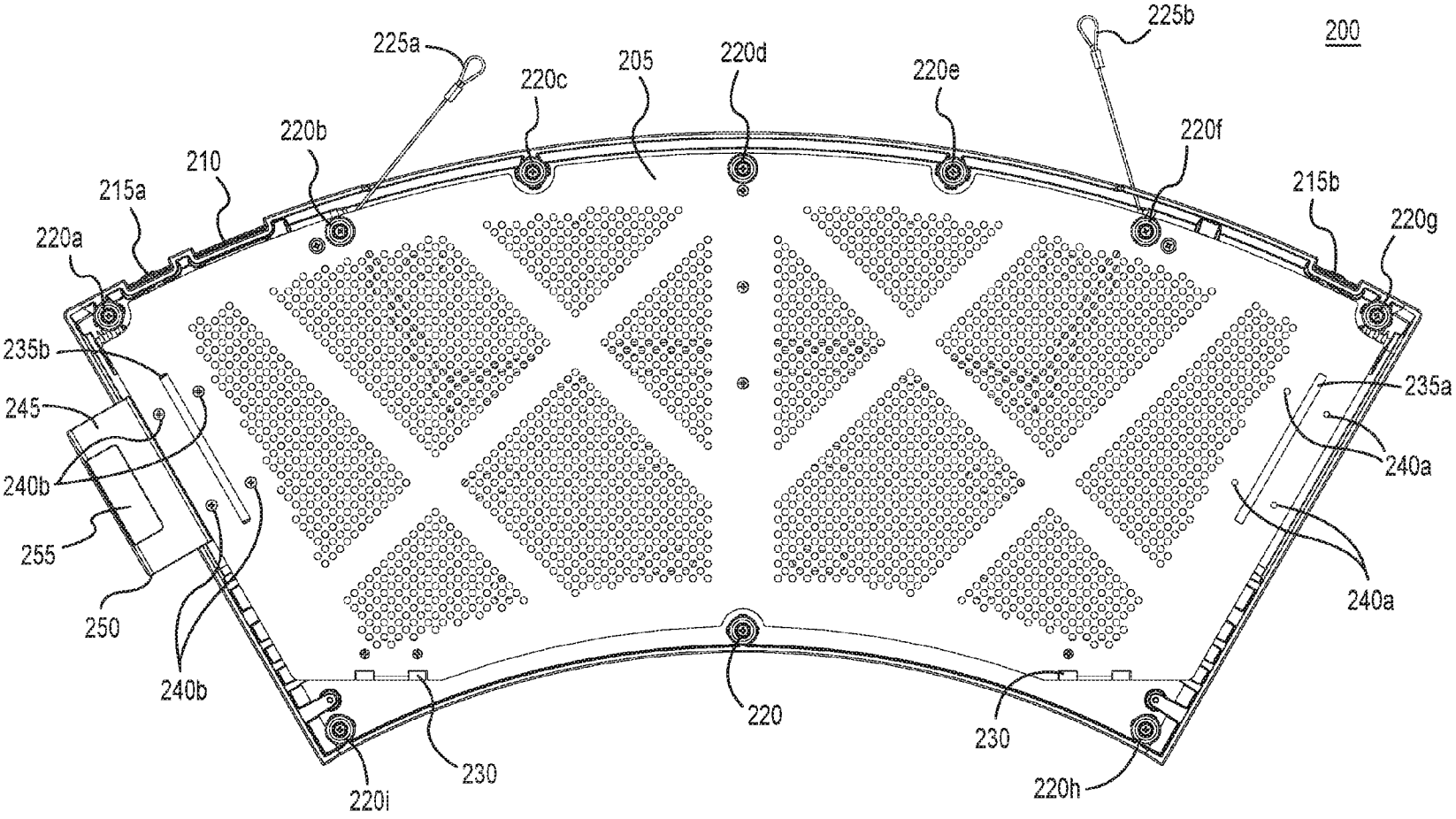
FIG. 2 illustrates a bottom view of the guitar pedal board.

FIG. 2 illustrates a bottom view of guitar pedal board 200, which is similar to guitar pedal board 100, shown in FIG. 1. Guitar pedal board 200 includes a bottom portion 205 which may also be constructed using any of the materials discussed above with respect to guitar pedal board 100. In one embodiment, guitar pedal board 200 may be constructed from aluminum and may include one or more vent holes to allow ambient air to flow through guitar pedal board 200. Guitar pedal board 200 may include one or more electrical transformers (not shown), attached to bottom portion 205 and/or contained inside guitar pedal board 200, which provide power to one or more guitar pedals. These electrical transformers generate heat which may be vented through the one or more vent holes.

In order to provide power to the electrical transformers attached to bottom portion 205 and/or contained inside guitar pedal board 200, guitar pedal board 200 provides a power port 210 which allows electrical power wires to pass through guitar pedal board 200 and access electrical power from an electrical power source, such as an electrical outlet. Guitar pedal board 200 may further include one or more audio cable ports, such as audio cable ports 215*a* and audio cable ports 215*b*. Audio cable ports 215*a* and audio cable ports 215*b* will be discussed in further detail below.

Guitar pedal board 200 may include one or more feet 220 configured to provide a non-slip connection point between guitar pedal board 200 and a surface on which it rests (such as a floor, or a stage). One or more feet 220 may be positioned either on guitar pedal board 200 or on bottom portion 205. FIG. 2 shows an exemplary placement for the one or more feet 220, identified as feet 220, 220*a*, 220*b*, 220*c*, 220*d*, 220*e*, 220*f*, 220*g*, 220*h*, and 220*i*. One or more feet 220 may be constructed using a rubber or other tacky plastic which are configured to be held to either guitar pedal board 200 or bottom portion 205 by a mechanical screw or other equivalent fastener.

Guitar pedal board 200 may further include one or more retainer devices which are configured to secure bottom portion 205 to the upper portion (not shown in FIG. 2) of guitar pedal board 200. To that end, FIG. 2 illustrates retainer cables, such as retainer cable 225*a* and retainer cable 225*b*. In one embodiment, retainer cable 225*a* and retainer cable 225*b* may be attached to bottom portion 205 and secure a retainer pin, as will be discussed further below. In one embodiment, retainer cable 225*a* and retainer cable 225*b* are constructed with braided steel wire and may be crimped on one or both ends to form one or more loops, as shown in FIG. 2. Retainer cable 225*a* and retainer cable 225*b* may be constructed with any other cable or cordage and may or may not be plastic coated, elasticized, or otherwise treated for convenience of use or aesthetic purposes.

Guitar pedal board 200 is configured to open and close during use by a musician. While the open and closing function of guitar pedal board 200 will be described in detail below, FIG. 2 illustrates at least one element of the system that provides the ability of guitar pedal board 200. Specifically, guitar pedal board 200 shows hinges 230. While FIG. 2 illustrates hinges 230 as two separate hinges, two hinges are not necessary to implement guitar pedal board 200. Any number of hinges 230 (one or more) may be used in various different positions on guitar pedal board 200. However, for purposes of explanation, hinges 230 are shown in FIG. 2 as two separate hinges. Hinges 230 connect bottom portion 205 to guitar pedal board surface 110, shown in FIG. 1 on the bottom (e.g. underside) of guitar pedal board 200. In other words, hinges 230, are disposed in parallel with a surface upon which guitar pedal board 200 sits (a floor or a stage, for example), when guitar pedal board 200 is closed. The functionality of the hinges in concert with other elements of guitar pedal board 200 will be discussed in further detail below.

One additional aspect of guitar pedal board 200 is the ability of guitar pedal board 200 to connect with another guitar pedal board. Guitar pedal board 200 includes a first slot 235*a* and a second slot 235*b* configured to receive attachment foot 245. Attachment foot 245 may be secured to an inside surface of a bottom portion 205 of guitar pedal board 200 with conventional fasteners such as screws or rivets through attachment points 240*a* or attachment points 240*b*. That is to say attachment foot 245 may be fastened to a surface of the bottom portion 205 of guitar pedal board 200 that is inside guitar pedal board 200 when guitar pedal board 200 is closed. Screws may thread into attachment foot 245 or, alternatively may be implemented as bolts that secure attachment foot 245 to bottom portion 205 of guitar pedal board 200. Attachment foot 245 may be constructed using aluminum, steel, or another metal and includes a bend of substantially 90° to create riser portion 250. In order to limit weight, attachment foot 245 may include one or more holes 255 to relieve attachment foot 245 of material that provides no benefit while increasing weight. Attachment foot 245 may include a riser portion 250 which is created by a bend and configured to be inserted into a slot on another guitar pedal board. Accordingly, attachment foot 245 provides a secure connection between two different guitar pedal boards, such as two of guitar pedal boards 200.

In one embodiment, three or four guitar pedal boards may be connected together using three or four of attachment foot 245. Each attachment foot 245 from each guitar pedal board may be connected to the guitar pedal board by inserting a riser portion of attachment foot 245 into second slot 235*b* of bottom portion 205 and attaching screws or bolts to attachment foot 245 at attachment points 240*b*. In turn, that attachment foot 245 may connect to another guitar pedal board by inserting a riser portion of attachment foot 245 into first slot 235*a* of another guitar pedal board. This process may be repeated, further connecting an additional guitar pedal board to one, two, or three other guitar pedal boards. Since guitar pedal board 200, like guitar pedal board 100, shown in FIG. 1, is implemented in an arc shape, six guitar pedal boards, each comprising approximately 60° of a circle may be fashioned together to form a circle of 360°. Three connected guitar pedal boards would form a 180° arc, while two guitar pedal boards would form a 120° arc. Other configurations are possible in which multiple smaller (30°, 45°, and etc.) or larger (90°, 120°, and etc.) guitar pedal boards may be connected together to form arcs of different sizes suited to a musician's preferences. Any angle of arc may be used for guitar pedal board 200 to suit any particular desired implementation. It should also be noted that other configurations for guitar pedal board 200 are also possible. For example, two or more boards may be connected as side by side in a rectangular shape. Two or more boards may further be connected in a polygonal shape to form two or more sides of a polygon, such as a pentagon, hexagon, heptagon, octagon, etc.

Figure 3:
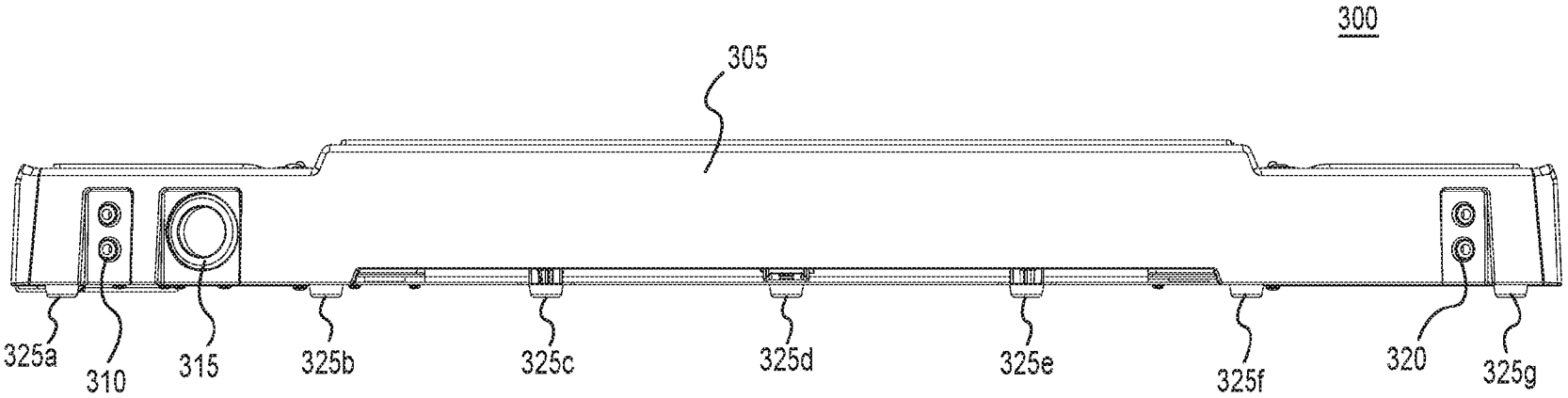
FIG. 3 illustrates a rear view of the guitar pedal board.

FIG. 3 illustrates a rear view of guitar pedal board 300, which is similar in implementation and description to guitar pedal board 200 shown in FIG. 2 and guitar pedal board 100 shown in FIG. 1. Guitar pedal board 300 includes a rear portion 305. Rear portion 305 of guitar pedal board 300 shows a power port 315, audio cable ports 310, and audio cable ports 320. Power port 315 is similar to power port 210, shown in FIG. 2. Electrical power cables carry electrical power to elements associated with the guitar pedal board that require power to operate (e.g., one or more transformers or one or more guitar pedals). Audio cable ports 310 and audio cable ports 320 are similar to audio cable ports 215*a* and audio cable ports 215*b*, shown in FIG. 2. Audio cables differ from electrical power cables in that audio cables carry electrical impulses representative of sound.

Power port 315 allows electrical wires to pass through rear portion 305 of guitar pedal board 300 and access electrical power from an electrical power source, such as an electrical outlet. Audio cable ports 310 and audio cable ports 320 serve as inputs or outputs for various guitar pedals used in conjunction with guitar pedal board 300. For example, when one or more guitar pedal boards are connected together, an audio cable may be connected as an output from one guitar pedal board and may be connected to an input to another guitar pedal board. Such an arrangement provides a musician with additional area to further modify a sound produced by a guitar with more guitar pedals than would fit on a single guitar pedal board. More simply put, audio cable ports 310 and audio cable ports 320 allow a musician to daisy chain guitar pedal boards together which, in turn, may provide additional space for daisy chained guitar pedals.

Guitar pedal board 300 further includes one or more feet similar in implementation to foot 220 shown in FIG. 2. In the embodiment shown in FIG. 3, one or more feet include foot 325*a*, foot 325*b*, foot 325*c*, foot 325*d*, foot 325*e*, foot 325*f*, and foot 325*g*. Feet 325*a*-325*g* provide a non-slip base for guitar pedal board 300 and support guitar pedal board 300 such that guitar pedal board 300 is not in direct contact with a surface such as a floor or a stage. Rather, feet 325*a*-325*g*, which are attached to guitar pedal board 300, are in direct contact with a surface such as a floor or a stage. Thus, ambient air is allowed to pass between guitar pedal board 300 and the surface on which guitar pedal board 300 rests (via feet 325*a*-325*g*) and hot air may be carried away from guitar pedal board 300 by vents within bottom portion 205 of guitar pedal board 200 shown in FIG. 2.

Figure 4:
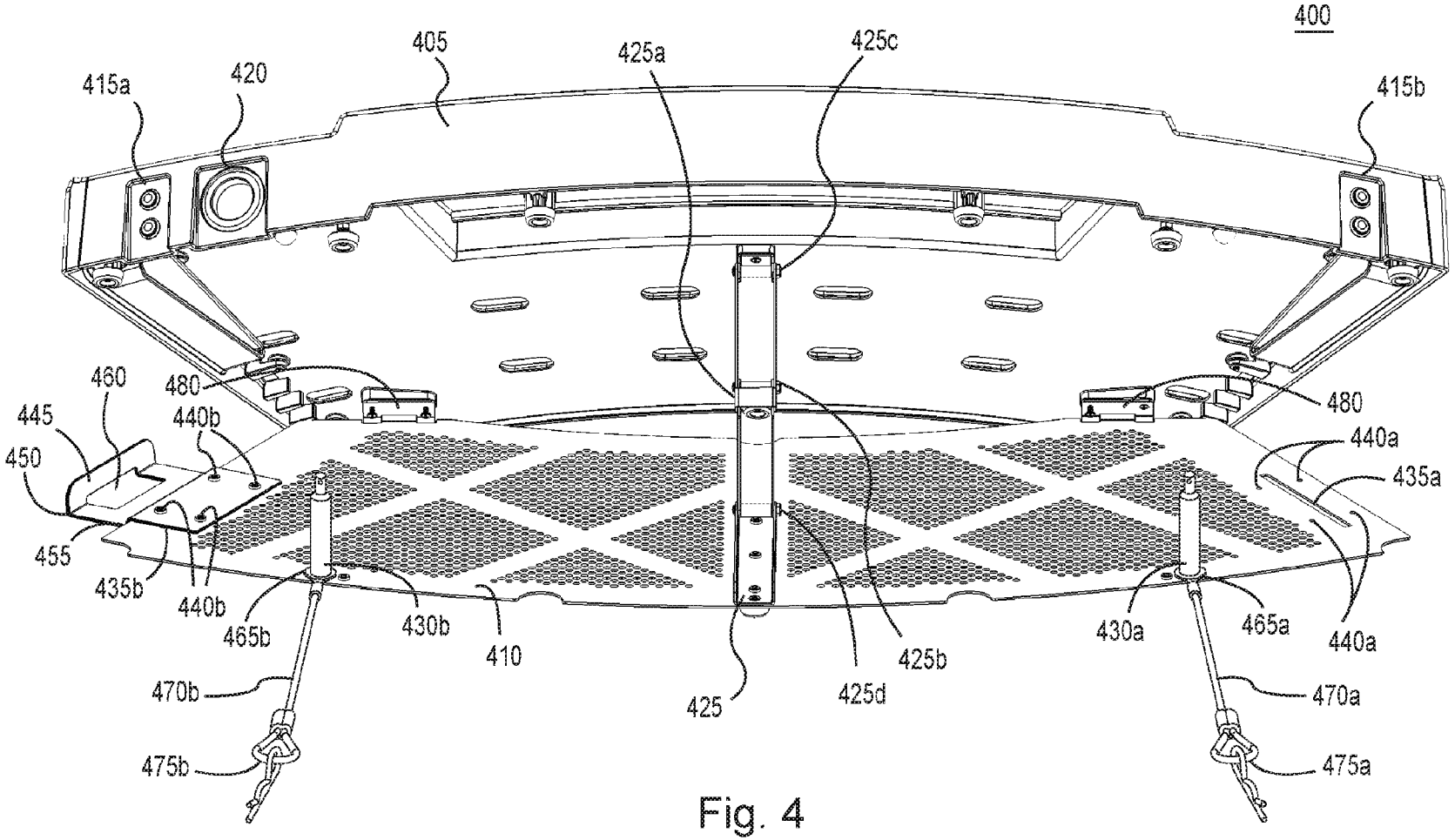
FIG. 4 illustrates a rear view of the guitar pedal board in an open position.

FIG. 4 illustrates a rear view of guitar pedal board 400 in open position. Guitar pedal board 400 may be similar in implementation and description to guitar pedal board 300 shown in FIG. 3, guitar pedal board 200 shown in FIG. 2, and guitar pedal board 100 shown in FIG. 1. Guitar pedal board 400 includes an upper portion 405 and a bottom portion 410 which may be firmly connected together in a closed position (as shown in FIGS. 1-3) or which may be separated from each other in an open position, as shown in FIG. 4. Upper portion 405 and bottom portion 410 may be connected at hinges 480 whether in an open or closed position. Hinges 480 serve as a pivot point to allow upper portion 405 to rotate up and away from bottom portion 410 when guitar pedal board 400 is opened.

In an open position, both the inside and outside of guitar pedal board 400 may be easily accessed by a musician. Because the musician can easily manipulate cables when guitar pedal board 400 is open, the musician can easily connect a number of guitar pedals positioned as described above on guitar pedal board 400. At the same time, guitar pedal board 400 may maintain wires inside guitar pedal board 400 when guitar pedal board 400 is closed facilitating a professional appearance during a presentation and preventing loose cables from creating a tripping hazard on the musician's performance surface (e.g., a floor or a stage). Further, during transport, a user need only ensure that guitar pedal board 400 is firmly closed to maintain the various cables remain inside guitar pedal board 400. Advantageously, each cable within guitar pedal board 400 may remain connected (with the exception of the power cable) even during transport. Thus, a user may not have to reconnect and disconnect the guitar pedals from the guitar pedal board 400 each time the user intends to use or transport guitar pedal board 400.

Upper portion 405 of guitar pedal board 400 may include power port 420, audio cable ports 415*a*, and audio cable ports 415*b*. Power port 420, audio cable ports 415*a*, and audio cable ports 415*b* may be similar in both implementation and description to power port 315, audio cable ports 310, and audio cable ports 320, shown in FIG. 3. Upper portion 405 of guitar pedal board 400 may be attached to bottom portion 410 by a support member 425. In one embodiment, support member 425 may include a locking mechanism 425*a* that prevents pivot point 425*b* from pivoting when locking mechanism 425*a* is engaged. Support member 425 may include one or more pivot points, such as pivot point 425*b*, pivot point 425*c*, and pivot point 425*d*. Pivot point 425*b*, pivot point 425*c*, and pivot point 425*d* will be discussed in further detail below. However, for the purposes of FIG. 4, each of pivot point 425*b*, pivot point 425*c*, and pivot point 425*d* pivot to allow support member 425 to selectably hold guitar pedal board 400 in an open position.

Bottom portion 410 of guitar pedal board 400 further includes one or more retainer stand, such as retainer stand 430*a* and retainer stand 430*b*. While two retainer stands, retainer stand 430*a* and retainer stand 430*b*, are shown in FIG. 4, the number and location of retainer stands implemented in guitar pedal board 400 may vary. Retainer stand 430*a* and retainer stand 430*b* are connected to bottom portion 410 using any suitable connection. For example, retainer stand 430*a* and retainer stand 430*b* may be internally threaded and may receive a screw or bolt inserted through the underside of bottom portion 410. Retainer stand 430*a* and retainer stand 430*b* may be attached to bottom portion 410 by weld, rivet, peening, or any other suitable method for fastening retainer stand 430*a* and retainer stand 430*b* to bottom portion 410 in a permanent and rigid manner. Retainer stand 430*a* and retainer stand 430*b* may be received into a retainer stand port (not shown in FIG. 4) within upper portion 405 of guitar pedal board 400 when guitar pedal board 400 is in a closed position (as shown in FIG. 1, retaining device 125*a* and retaining device 125*b*).

Retainer stand 430*a* and retainer stand 430*b* are shown as being generally conical and tapered. However, retainer stand 430*a* and retainer stand 430*b* may be implemented in any shape and may be a consistent diameter or thickness. As shown in FIG. 4, retainer stand 430*a* and retainer stand 430*b* taper between a first diameter and a second diameter. The second diameter may be a smaller diameter than the first diameter. In one embodiment, retainer stand 430*a* and retainer stand 430*b* may include an aperture configured to receive a retaining cross pin. The aperture may be disposed within retainer stand 430*a* and/or retainer stand 430*b* horizontally and positioned such that when guitar pedal board 400 is closed, the aperture may receive a retaining cross pin.

In another embodiment, a first retaining cross pin wire eyelet 465*a* may be disposed between bottom portion 410 and retainer stand 430*a* while a second retaining cross pin wire eyelet 465*b* may be disposed between bottom portion 410 and retainer stand 430*b*. First retaining cross pin wire eyelet 465*a* may be crimped, or otherwise attached, to a retaining cross pin wire 470*a*, which ends in crimped loop that secures retaining cross pin 475*a*. Second retaining cross pin wire eyelet 465*b* may be crimped, or otherwise attached, to a retaining cross pin wire 470*b*, which ends in a crimped loop that secures retaining cross pin 475*b*. Accordingly, when guitar pedal board 400 is closed, retainer stand 430*a* and retainer stand 430*b* pass through a retainer stand port within upper portion 405 and protrude above the surface of upper portion 405 such that retaining cross pin 475*a* and retaining cross pin 475*b* may be installed through the aperture within retainer stand 430*a* and retainer stand 430*b*, respectively. Guitar pedal board 400 may therefore be securely held in a closed position.

Guitar pedal board 400 may further include one or more slots, such as first slot 435*a* and second slot 435*b* (shown as disposed under attachment foot 445) which are similar in implementation and description to first slot 235*a* and second slot 235*b*, shown in FIG. 2. Attachment points 440*a* and attachment points 440*b* are also similar in implementation and description to attachment points 240*a* and attachment points 240*b*, shown in FIG. 2. Attachment foot 445 may be secured to guitar pedal board 400 with screws through attachment points 440*a* and/or attachment points 440*b*, as discussed above. Attachment foot 445 may include one or more holes 460 to relieve attachment foot 445 of unnecessary weight. Further, attachment foot 445 a may include a riser portion 450 that is substantially perpendicular (approximately 90°) to a horizontal portion 455 of attachment foot 445. Riser portion 450 is configured to be received by a slot in another guitar pedal board that is similar to first slot 435*a*. Thus, one or more guitar pedal boards may be connected together as described above with respect to FIG. 2.

Figure 5:
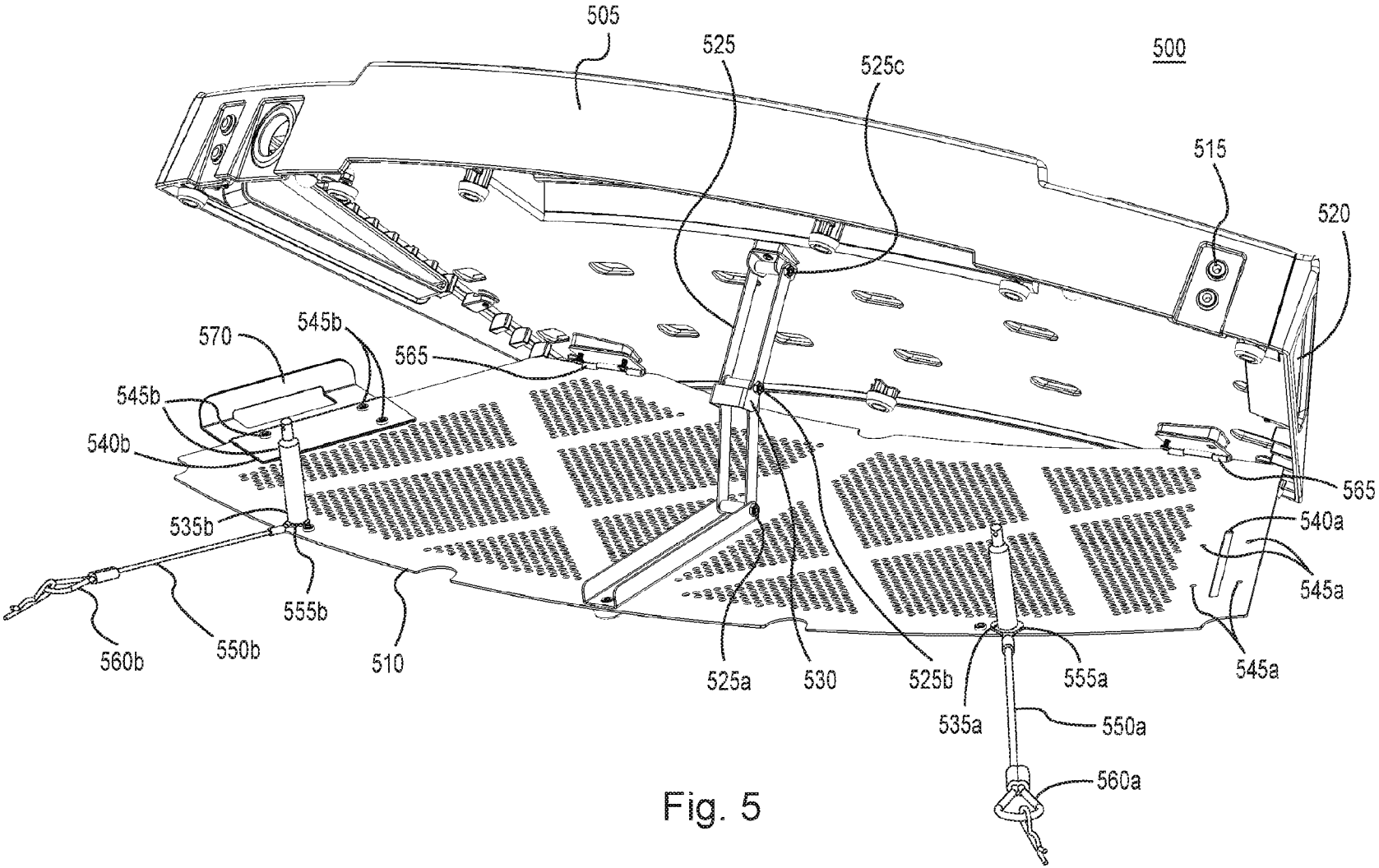
FIG. 5 illustrates a rear perspective view of the guitar pedal board in an open position.

FIG. 5 illustrates a rear perspective view of guitar pedal board 500 in an open position. Guitar pedal board 500 may be similar in implementation and description to guitar pedal board 400 shown in FIG. 4, guitar pedal board 300 shown in FIG. 3, guitar pedal board 200 shown in FIG. 2, and guitar pedal board 100 shown in FIG. 1. Guitar pedal board 500 includes an upper portion 505 and a bottom portion 510 which may be firmly connected together in a closed position (as shown in FIGS. 1-3) or which may be separated from each other in an open position, as shown in FIG. 4 and FIG. 5. Upper portion 505 and bottom portion 510 may be connected at hinges 565 whether in an open or closed position. Hinges 565 serve as a pivot point to allow upper portion 505 to rotate up and away from bottom portion 410 when guitar pedal board 500 is opened.

Upper portion 505 of guitar pedal board 500 may include both power ports and audio cable ports, discussed above, and represented in FIG. 5 as ports 515 which may be connected via electrical cables to power ports or audio cable ports of other guitar pedal boards. Upper portion 505 may further include handles, discussed above, and represented in FIG. 5 as handle 520. Upper portion 505 may be attached to bottom portion 510 by support member 525. Support member 525 is shown in FIG. 5 as a series of metal channels interconnected by pivot point 525*a*, pivot point 525*b*, and pivot point 525*c*. Support member 525 further includes a lock 530 that prevents pivot point 525*b* from pivoting when lock 530 is engaged. Support member 525 includes a first section of metal channel that is fastened to bottom portion 510 using screws, although any fastener known in the art would be suitable for fastening the first section of metal channel to bottom portion 510. Pivot point 525*a* interconnects the first section of metal channel to two metal arms (one arm on each side of the pivot point 525*a*) and allows the two metal arms to pivot from being disposed within the metal channel when guitar pedal board 500 is closed to between 80° and 100° (relative to bottom portion 510) when guitar pedal board 500 is open.

The two metal arms (referred to as being made of metal in a preferred embodiment but can be constructed using any material disclosed herein) connect to pivot point 525*b* on either side of pivot point 525*b*, as shown in FIG. 5. As guitar pedal board 500 is opened, pivot point 525*b* allows the two metal arms to extend to a maximum extension point. At the maximum extension point for the two metal arms, lock 530 may be engaged to prevent pivot point 525*b* from further rotation. At this point, guitar pedal board 500 is fully open and provides a musician with access to connect wiring for guitar pedals. Because lock 530 prevents pivot point 525*b* from further rotation, support member 525 is locked in an open position and will not allow guitar pedal board 500 to close until lock 530 is disengaged.

Pivot point 525*b* is further connected to a second metal channel which is, in turn, connected to pivot point 525*c*. When guitar pedal board 500 is closed, the second metal channel rests on the first metal channel, effectively allowing support member 525 to fold into the first metal channel. However, when guitar pedal board 500 is open, pivot point 525*c* allows the second metal channel to pivot in a bracket connected to upper portion 505 up to the point of maximum extension for the second metal channel. Thus, support member 525 may be fully extended to secure guitar pedal board 500 in an open position.

Support member 525 is not adjustable although support member 525 may be extendible around one or more pivot points 525*a*, 525*b*, and/or 525*c* to fold, in a manner of speaking, to facilitate an open and closed position of guitar pedal board 525. That is to say that as support member 525 is extended and upper portion 505 separates from bottom portion 510, support member 525 rotates around a pivot point to extend or unfold from a first length when guitar pedal board 500 is closed to an extended length when guitar pedal board 500 is opened. Support member 525 is configured to be selectively articulated to open guitar pedal board 500 and close guitar pedal board 500. Further, support member 525 is not intended to hold guitar pedal board 500 open for use by a musician during a performance. Rather, as guitar pedals may be mounted to the surface of guitar pedal board 500 while guitar pedal board 500 is open, the open guitar pedal board allows for easy wiring access. Support member 525 shown in FIG. 5 is a single implementation of support member 525 that is shown for purposes of discussion. Multiple support members could be implemented. Further, support member 525 may be implemented using other techniques which are not shown in FIG. 5. In one example, guitar pedal board 500 may implement support member 525 as a prop kick stand. Support member 525 may be implemented as one or more gas shocks which exert pressure on both upper portion 505 and bottom portion 510 when compressed (e.g., when guitar pedal board 500 is closed). Numerous implementations for support member 525 are possible and may be used to hold guitar pedal board 500 in an open position. Further, these exemplary support member 525 configurations may include one or more pivot points that prevent these exemplary support members 525 from binding when guitar pedal board 500 is opened.

Bottom portion 510 of guitar pedal board 500 further includes one or more retainer stand, such as retainer stand 535*a* and retainer stand 535*b*, which are similar in implementation and description to retainer stand 430*a* and retainer stand 430*b*, shown in FIG. 4. Retainer stand 535*a* and retainer stand 535*b* may both include an aperture, as described above with respect to FIG. 4, configured to receive a retaining cross pin.

In one embodiment, a first retaining cross pin wire eyelet 555*a* may be disposed between bottom portion 510 and retainer stand 535*a* while a second retaining cross pin wire eyelet 555*b* may be disposed between bottom portion 510 and retainer stand 535*b*. First retaining cross pin wire eyelet 555*a* may be crimped, or otherwise attached, to retaining cross pin wire 550*a*, which ends in a crimped loop that secures retaining cross pin 560*a*. Second retaining cross pin wire eyelet 555*b* may be crimped, or otherwise attached, to a retaining cross pin wire 550*b*, which ends in a crimped loop that secures retaining cross pin 560*b*. Accordingly, when guitar pedal board 500 is closed, retainer stand 535*a* and retainer stand 535*b* pass through a retainer stand port within upper portion 505 and protrude above the surface of upper portion 505 such that retaining cross pin 560*a* and retaining cross pin 560*b* may be installed through the aperture within retainer stand 535*a* and retainer stand 535*b*, respectively. Guitar pedal board 500 may therefore be held securely in a closed position.

Guitar pedal board 500 may further include one or more slots such as first slot 540*a* and second slot 540*b* (shown as disposed under attachment foot 570) which are similar in implementation and description to first slot 435*a* and second slot 435*b*, shown in FIG. 4. Attachment points 545*a* and attachment points 545*b* are also similar in implementation and description to attachment points 440*a* and attachment points 440*b*, shown in FIG. 4. Attachment foot 570 may be secured to guitar pedal board 500 with screws through attachment points 545*a* or attachment points 545*b*, as discussed above. Attachment foot 570 may further facilitate connecting one or more guitar pedal boards together, as described above.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A pedal board comprising:

an upper portion;

a bottom portion;

a support member including a first set of arms disposed between a channel mounted to the bottom portion of the pedal board and a midpoint of the support member, wherein a length of the support member is extendible around at least one pivot point positioned at the midpoint of the support member, wherein the support member is connected inside the pedal board to the upper portion of the pedal board and the bottom portion of the pedal board.

2. The pedal board of claim 1, wherein the length of the support member corresponds to the height of the upper portion of the pedal board above the bottom portion of the pedal board when the pedal board is open.

3. The pedal board of claim 1, further comprising:

a second pivot point in the support member.

4. The pedal board of claim 3, further comprising:

a third pivot point in the support member.

5. The pedal board of claim 1, wherein the support member folds into the channel when the pedal board is closed.

6. The pedal board of claim 1, wherein the support member includes a locking mechanism.

7. The pedal board of claim 6, wherein the locking mechanism locks the support member in place when the pedal board is open.

8. The pedal board of claim 1, wherein the pedal board further includes at least one hinge connecting the upper portion of the pedal board to the bottom portion of the pedal board.

9. The pedal board of claim 1, further comprising at least one retainer device.

10. The pedal board of claim 1, wherein the support member includes:

a second set of arms disposed between the midpoint of the support member and the upper portion of the pedal board.

11. A pedal board system comprising:

a first pedal board having a top portion and a bottom portion;

a second pedal board; and an attachment foot, including a riser portion, and connected to the bottom portion of the first pedal board on a top surface of the bottom portion inside the first pedal board, the riser portion of the attachment foot configured to be received from the underside by a slot in an underside of the second pedal board.

12. The pedal board system of claim 11, wherein the attachment foot is connected by one or more fasteners to the first pedal board.

13. The pedal board system of claim 12, wherein the riser portion of the attachment foot is substantially 90 degrees to a horizontal portion of the attachment foot.

14. The pedal board system of claim 11, wherein the first pedal board and the second pedal board are connected to form a 120 degree arc.

15. The pedal board system of claim 14, wherein an audio output cable connected to the first pedal board is further connected to an audio input port of the second pedal board.

16. The pedal board system of claim 11, further comprising:

a third pedal board connected to the second pedal board by a second attachment foot.

17. The pedal board system of claim 16, wherein the first pedal board, the second pedal board, and the third pedal board are connected to form a 180 degree arc.

* * * * *